United States Patent [19]

Vasilkovsky et al.

[11] 4,127,019

[45] Nov. 28, 1978

[54] HYDRAULIC PRESS CROSSHEAD CONTROL SYSTEM

[76] Inventors: Vitaly P. Vasilkovsky, ulitsa Baumana, 4b, kv. 35; Vladimir I. Koires, ulitsa Bakinskikh komissarov, 58, kv. 83; Sergei G. Khirdzhiev, ulitsa Bakinskikh komissarov, 58, kv. 48; Viktor I. Chekmenev, ulitsa XXII Partsiezda, 19, kv. 20, all of Sverdlovsk, U.S.S.R.

[21] Appl. No.: 797,791

[22] Filed: May 17, 1977

[51] Int. Cl.[2] ..... B21J 9/20

[52] U.S. Cl. ..... 72/21; 100/48

[58] Field of Search ..... 100/48; 72/21, 22

[56] References Cited

U.S. PATENT DOCUMENTS

| | | | |
|---|---|---|---|
| 2,962,960 | 12/1960 | Salter | 72/21 |
| 3,044,389 | 7/1962 | Rexford | 100/48 |
| 3,138,976 | 6/1964 | Robra | 100/48 |
| 3,196,647 | 7/1965 | Schneider | 72/21 |

*Primary Examiner*—Lowell A. Larson
*Attorney, Agent, or Firm*—Fleit & Jacobson

[57] ABSTRACT

The present invention relates to hydraulic crosshead control systems and may be most advantageously used in free forging hydraulic presses. The system comprises a valve-type hydraulic distributor and a mechanical feedback system which includes two rotatable members mounted on a drive shaft, one member being mounted for progressive movement relative to the shaft by the amount directly proportional to the angle of rotation thereof, and the other member is rigidly secured to the shaft.

The hydraulic distributor drive has a member picking-up a feedback signal which is incorporated in the drive in such a manner as to prevent the signal from being transmitted to the manual control handle. The system according to the invention is simple in structure and reliable in operation.

5 Claims, 2 Drawing Figures

HYDRAULIC PRESS CROSSHEAD CONTROL SYSTEM

The present invention relates to hydraulic presses and more particularly to control systems for controlling a movable crosshead of such presses.

The invention may be most advantageously used in free forging hydraulic presses in which the crosshead is to be stopped in a desired position independently of the operator.

Known in the art are constructions of hydraulic presses in which various crosshead control systems are used comprising a control member in the form of a valve-type distributor, and a feedback system. The feedback system normally includes a sensor of the crosshead position, a sensor signal amplifier, a converter for converting the electric signal into a mechanical or hydraulic signal, and an amplifier for the latter signal acting on the hydraulic distributor which controls the crosshead.

Though such system provides for required accuracy of stoppage of the movable crosshead, it is complicated in operation in the metal production shop conditions and is rather unreliable. This is due to the fact that the system sometimes fails to operate thus resulting in spoiling of product. It should be noted that spoiling, especially in large free forging presses, is associated with high losses of both production time and metal.

A control system with mechanical feedback is more reliable in operation and less complicated in structure.

Known in the art are hydraulic crosshead control systems including a driven valve-type hydraulic distributor having valves cooperating, via tappets, with a camshaft which is connected to a manual control handle, and a mechanical feedback system. The mechanical feedback system comprises rotatable members mounted on a drive shaft, one member being made in the form of a sector with projections, and the other member comprising a worm gear also having projections on the end face thereof which engage the sector projections. The same shaft carries a rigidly fixed gear meshing with a tooth rack connected to the crosshead.

The worm gear meshes with a worm which is in a rigid force transmitting connection with the distributor drive.

A feedback signal is transmitted in the following way. Upon rotation of the shaft, hence of the sector, through an angle proportional to the amount of displacement of the crosshead, the sector projections engage the worm gear projections. The worm gear is rotated to cause axial displacement of the worm, and a feedback signal is fed to the drive of the hydraulic distributor to close its valves.

The main disadvantage of such system resides in a limited accuracy of stoppage of the crosshead. This is due to the fact that, to obtain a required accuracy of stoppage, the distributor valves should be closed with sufficiently small amount of displacement of the crosshead. Therefore, the rotatable members should be gradually brought into engagement to obtain a small amount of displacement. At the same time, the sector cooperates with the worm gear upon moving along an arc of a circle which corresponds, in a certain scale, to the crosshead stroke. Therefore, to improve the accuracy of stoppage, the diameter of the worm gear is to be increased which is undesirable and complicates the construction; or the axial displacement required for stoppage of the crosshead is to be reduced which would involve the employment of additional means complicating the construction and impairing operation of the system.

It is an object of the invention to provide a hydraulic press crosshead control system having a mechanical feedback improving the accuracy of stoppage of the crosshead.

Another object of the invention is to provide a crosshead control system which is simple in structure.

An important object of the invention is to provide a crosshead control system which improves the operation conditions in the automatic mode.

The above and other objects are accomplished by that in a hydraulic crosshead control system including a driven valve-type hydraulic distributor having valves cooperating, via tappets with a camshaft connected to a manual control handle, and a mechanical feedback system comprising two driven members mounted on a drive shaft, the members having projections on the end faces thereof, one member being connected to the crosshead and the amount of its rotation being directly proportional to the amount of displacement of the crosshead, and the other member is connected to the distributor drive for transmission of a feedback signal thereto upon cooperation of the projections, wherein, according to the invention, one of the members is mounted for progressive movement relative to the shaft by the amount which is directly proportional to the angle of rotation thereof for gradually bringing the projections into engagement, the drive of the hydraulic distributor having an additional member picking up a feedback signal appearing upon gradual engagement of the projections, the additional member being incorporated in the drive in such a manner as to prevent the feedback signal from being transmitted to the manual control handle.

This construction provides for accurate stoppage of the crosshead and improves the operation conditions because gradual engagement of the drum and worm gear permits any desired number of revolutions of the drum to be performed which are required for a pre-set accuracy of stoppage until it comes into engagement with the worm gear. The provision of the additional member for picking up the feedback signal improves automatic operation conditions.

According to the invention, the rotatable member mounted for progressive movement preferably comprises a drum connected to the drive shaft by means of a screw coupling, the projections being provided on one end face of the drum, and a flexible member is wound on and fixed to the outer surface of the drum, the flexible member being connected to an equiarm lever having one arm connected to one end of the crosshead and the other arm connected to the other end of the crosshead, the other rotatable member being rigidly secured to the shaft.

This construction is the simplest and most convenient for maintenance.

The additional member is preferably made in the form of an additional camshaft with a booster which picks up a feedback signal and extends in parallel with the camshaft of the hydraulic distributor, the distributor tappets having rocker arms cooperating with the cams of both shafts which are rotated either upon receiving a feedback signal or a signal from the manual control handle.

The invention will be better understood from the description of the following specific embodiment thereof illustrated in the accompanying drawings, in which.

Figure 1:
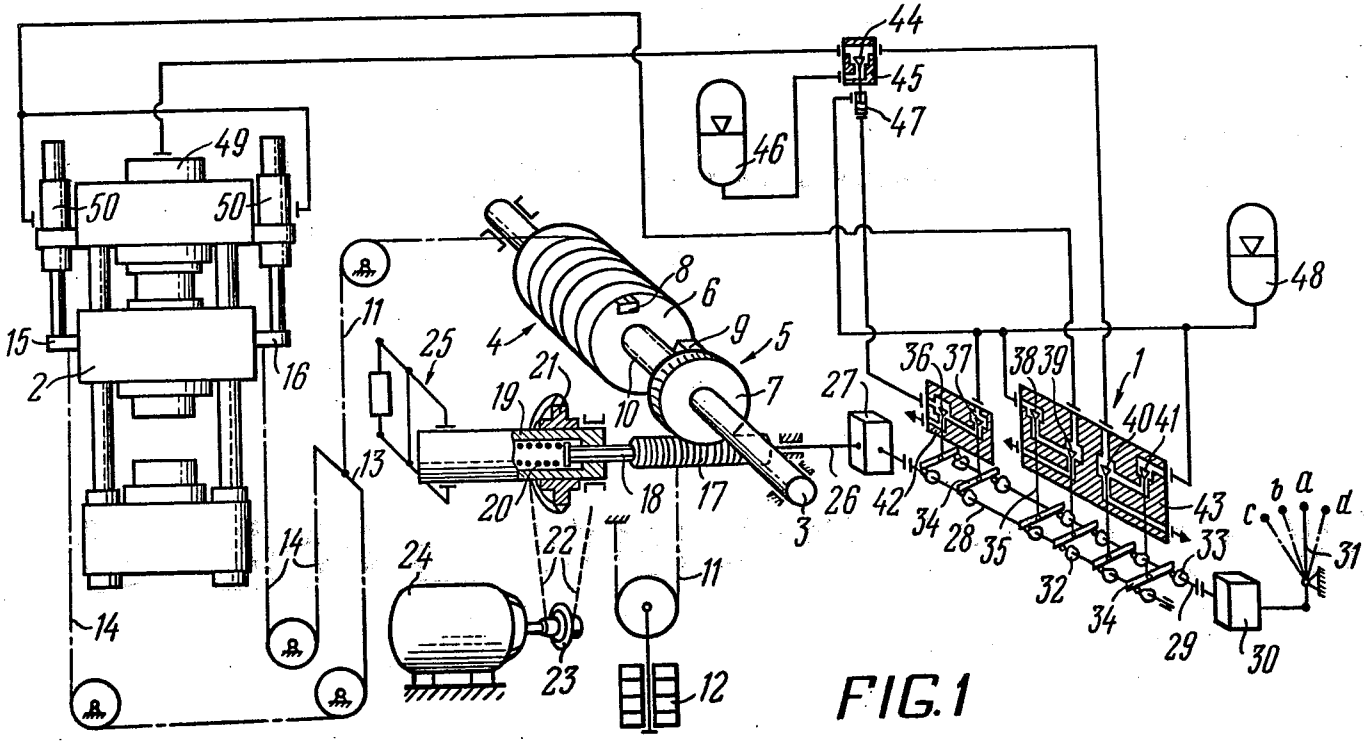
FIG. 1 shows a perspective view illustrating a principle diagram of the crosshead control system.

The control system according to the invention comprises a valve-type hydraulic distributor 1 (FIG. 1) controlling a press crosshead 2, and a mechanical feedback system. The feedback system includes a drive shaft 3 having rotatable members 4 and 5, the rotatable member 4 comprising a drum 6, the rotatable member 5 being made in the form of a worm gear 7. The end faces of the drum and worm gear are provided with projections 8 and 9, respectively, and the drum is mounted on the shaft 3 by means of a screw coupling 10, the worm gear being rigidly secured to the shaft.

The provision of the screw coupling 10 enables the progressive movement of the drum 6 along the shaft 3 by the amount which is directly proportional to the angle of rotation of the shaft. As a result, the projections 8 and 9 are gradually brought into engagement.

A flexible member 11 is wound on and fixed to the outer surface of the drum 6, and one end of the flexible member has a weight 12 so that the flexible member is permanently tensioned.

The other end of the flexible member 11 is connected to an equiarm lever 13 having its arms connected, by means of another flexible member 14, to the ends 15, 16 of the crosshead 2.

The worm gear 7 meshes with a worm 17 having one end 18 mounted in a cup-shaped member 19. The cup-shaped member 19 accommodates a spring 20 acting on the end 18 of the worm 17 to displace it into the extreme right hand position (as shown). The cup-shaped member 19 has a sprocket 21 which is connected, by means of a chain transmission 22, to another sprocket 23 mounted on the shaft of an electric motor 24. A brake 25 is provided for locking the cup-shaped member 19.

The other end of the worm 17 is connected by means of a rigid link 26, via a hydraulic booster 27, to an additional member 28 incorporated in the drive of the hydraulic distributor 1. The additional member 28 comprises a camshaft and is designed for picking up a feedback signal. Apart from the additional member 28, the drive of the hydraulic distributor 1 has a camshaft 29 which has one end connected, via a booster 30, to a manual control handle 31. The shafts 28 and 29 extend in parallel with each other.

The manual control handle 31 may take various positions: "Stop" which is indicated at "*a*" in the drawing; "Lowering" of the crosshead until it engages a blank — "*b*"; "Work Stroke" — "*c*"; and "Lifting" of the crosshead to the initial position — "*d*".

Figure 2:
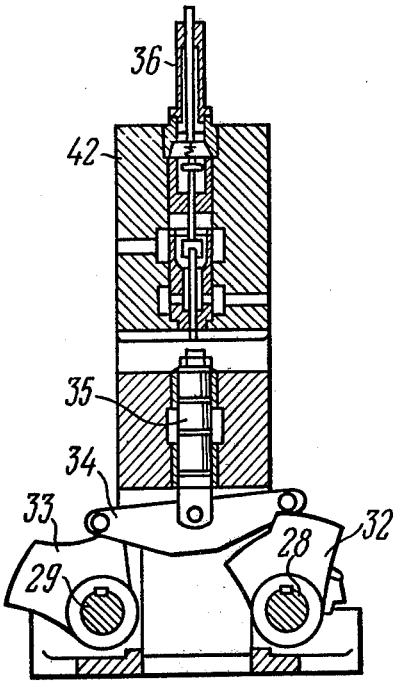
FIG. 2 is a longitudinal section of a valve tappet and rocker arm.

The shafts 28 and 29 (FIG. 2) have cams 32 and 33, respectively, cooperating with rocker arms 34 mounted on tappets 35. The tappets drive valves 36, 37, 38, 39, 40 and 41 which are accommodated in housings 42 and 43, respectively (FIG. 1). The hydraulic system also has a filling valve 44 mounted in a housing 45 connected to a low-pressure hydropneumatic vessel 46 and controlled by a servodrive 47 by means of the hydraulic distributor 1. There is also provided a high-pressure liquid accumulator 48 feeding liquid via the distributor 1 to hydraulic cylinders 49 and 50 of the crosshead 2.

The system operates, in the manual control mode, in the following manner.

The manual control handle 31 is set in the position "d" ("Lifting"). The camshaft 29 is in such a position that its cams 33 act on the rocker arm 34 to cause the valves 36–41 of the distributor 1 to take the position at which the crosshead 2 performs a full return stroke. Then the electric motor 24 rotates the worm 17 in such a manner that the drum 6 is displaced along the screw coupling 10 at maximum distance away from the worm gear 7 due to rotation of the worm gear 7 with the shaft 3. Subsequently, by consecutively placing the manual control handle 31 into the positions "Stop" — "*a*", "Lowering" — "*b*" — and "WorkStroke" — "*c*" — the crosshead 2 can be lowered to the lowermost position because during lowering of the crosshead, the weight 12 rotates the drum 6 to wind thereon the released portion of the flexible member 11 and to move the drum nearer to the worm gear 7 at a distance at which the projections 8 of the drum 6 and projections 9 of the worm gear 7 do not, however, come into engagement so that the feedback is disabled during the entire stroke of the crosshead.

The transition from the manual control to the positive stoppage mode is carried out as follows. The manual control handle 31 is placed in the position "Lowering" — "*b*" — the crosshead 2 is lowered to the lowermost position, the handle 31 is placed in the position "Work Stroke" — "*c*". Then rotation of the electric motor 24 causes the shaft 3 and the worm gear 7 to rotate thus bringing the drum 6 nearer to the worm gear 7 along the screw coupling. As a result, at a certain moment, the projections 9 of the worm gear 7 will bear against the projections 8 of the drum 6, and the worm gear 7 is stopped. Thus, the worm 17, which continues to rotate, is axially displaced to compress the spring 20 and to act on the booster 27 via the rigid link 26. This will result in rotation of the camshaft 28 of the additional member to act with its cams 32 on the rocker arms 34 thus causing the valves 36–41 of the distributor 1 to take the positions corresponding to the positions of the handle 31 in a sequence, that is the positions "*b*", "*a*", and "*d*". The crosshead 2 starts lifting, and, beginning with this moment, the "zero" position of the electric motor 24 is fixed. When the crosshead 2 reaches a pre-set position, the electric motor 24 is stopped. Thus the crosshead 2 is stopped, and the spring 20 remains expanded. Then, the crosshead 2 may be moved and the work stroke thereof may be set up within the range from the "pre-set" and "uppermost" positions by manipulating with the manual control handle. Upon reaching the "pre-set" position of the crosshead 2 during operation, the crosshead is stopped independent on the position of the manual control handle 31, because the projections 8 of the drum 6 rotated under the action of the weight 12 engage the projections 9 of the worm gear 7 before that moment. As a result of rotation of the worm gear 7, axial displacement of the worm 17 and rotation of the camshaft 28 of the additional member, the valves 36–41 of the distributor 1 will be in the position "Stop" — "*a*".

The control system according to the invention may also function automatically with the provision of an automatic control unit (not shown) which causes rotation of the electric motor 24 in different directions or stops it in accordance with a pre-set programme and which, upon placing the manual control handle 31 in the position "*c*", will cause the displacement of the crosshead 2 up or down, or its stoppage at a pre-set position in accordance with the same programme. At any moment, the operation of the press may be suspended, and the crosshead 2 may be lifted to the uppermost position by placing the manual control handle 31 in the position "*d*".

We claim:

1. A control system for controlling a hydraulic press crosshead having stop, lifting, lowering and work strokes, the work stroke including a lowering and a lifting portion, comprising:

hydraulic distributor means for controlling supply of hydraulic pressure to the hydraulic press crosshead, said hydraulic distributor means including a hydraulic distributor having valves, means for connecting said hydraulic distributor to a source of hydraulic pressure, a camshaft for changing the position of said valves, tappets for connecting said camshaft to said valves, and manual control means for adjusting the position of said camshaft thereby controlling stop, lifting, lowering and work strokes of the hydraulic press crosshead, adjustment of the camshaft changing the position of said valves thereby controlling the supply of hydraulic pressure to the hydraulic press crosshead; and mechanical feedback system means for automatically varying the position of said tappets in response to the hydraulic press crosshead reaching a predetermined position during the work stroke, said mechanical feedback system means including a rotatable drive shaft, a first member mounted for axial movement on said drive shaft, a second member mounted for rotation with said drive shaft, said first member including projection means engageable with said second member for stopping rotation of said second member and thereby stopping rotation of said drive shaft, flexible means for operatively connecting said first member with the hydraulic press crosshead so that said first member moves axially along said drive shaft a distance directly proportional to the amount of displacement of the hydraulic press crosshead, rotating means for rotating said drive shaft and operative to rotate said drive shaft in a first direction during a lifting stroke of the hydraulic press crosshead so that said first member moves away from said second member and operative to rotate said drive shaft in a direction opposite said first direction during the lowering portion of the work stroke of the hydraulic press crosshead so that said first member gradually moves toward said second member into a position wherein said projection means engages and stops the rotation of said second member, and feedback means responsive to the engagement of said second member by said first member and operatively associated with a portion of said hydraulic distributor means for stopping the lowering portion of the work stroke of the hydraulic press and for starting the lifting portion, said feedback means being independent from said manual control means.

2. A control system according to claim 1, wherein the hydraulic press crosshead has a first end and a second end and wherein said first member comprises a drum having one end facing said second member and an outer surface, and a screw coupling for connecting said drum to said drive shaft, said projection means comprises first projections provided on the facing end of the drum and second projections positioned on said second member and engageable by said first projections, and wherein said flexible means comprises a flexible member wound on and fixed to the outer surface of the drum, and an equiarm lever connected to the flexible member and having one arm connected to the first end of the hydraulic press crosshead and the other arm connected to the second end of the hydraulic press crosshead.

3. A control system according to claim 1, wherein the engagement of said secod member by said first member generates a feedback signal and said feedback means comprises a booster responsive to said feedback signal and an additional camshaft operatively associated with said booster and extending in parallel with the camshaft of said hydraulic distributor means, said tappets having rocker arms cooperating with the cams of both camshafts during rotation of the camshafts.

4. A control system according to claim 3, wherein both camshafts are rotated by said feedback signal.

5. A control system according to claim 3, wherein both camshafts are caused to rotate by said manual control means.

* * * * *